US007617755B2

(12) United States Patent
Bean et al.

(10) Patent No.: US 7,617,755 B2
(45) Date of Patent: Nov. 17, 2009

(54) MITER SAW

(75) Inventors: Frederick R. Bean, Finksburg, MD (US); Peter Chaikowsky, Bel Air, MD (US); Robert P. Welsh, Hunt Valley, MD (US); Craig A. Oktavec, Forest Hill, MD (US); Mark E. Brunson, Bel Air, MD (US); James R. Parks, White Hall, MD (US); Gregg L. Sheddy, Shrewsbury, PA (US); Adan Ayala, Baltimore, MD (US)

(73) Assignee: Black & Decker Inc., Newark, DE (US)

( * ) Notice: Subject to any disclaimer, the term of this patent is extended or adjusted under 35 U.S.C. 154(b) by 883 days.

(21) Appl. No.: 10/054,257

(22) Filed: Jan. 22, 2002

(65) Prior Publication Data

US 2002/0100351 A1 Aug. 1, 2002

Related U.S. Application Data

(60) Provisional application No. 60/265,567, filed on Feb. 1, 2001.

(51) Int. Cl.
*B26D 7/22* (2006.01)
*B26D 1/14* (2006.01)

(52) U.S. Cl. ..... 83/478; 83/471.3; 83/581

(58) Field of Classification Search ..... 83/490, 83/581, 468.7, 477.1, 477, 698.51, 698.41, 83/478, 698.11, 471.3, 468.2, 468.3
See application file for complete search history.

(56) References Cited

U.S. PATENT DOCUMENTS

| | | | | |
|---|---|---|---|---|
| 3,998,121 | A | 12/1976 | Bennett | |
| 5,042,348 | A * | 8/1991 | Brundage et al. | 83/471.3 |
| 5,297,463 | A | 3/1994 | O'Banion et al. | |
| 5,595,124 | A | 1/1997 | Wixey et al. | |
| 5,778,747 | A * | 7/1998 | Chen | 83/471.3 |
| 5,855,366 | A * | 1/1999 | Chang | 269/315 |
| 5,950,514 | A * | 9/1999 | Benedict et al. | 83/397 |
| 5,957,021 | A * | 9/1999 | Meredith et al. | 83/397 |
| 6,279,442 | B1 * | 8/2001 | Chang | 83/397 |
| 6,418,830 | B1 * | 7/2002 | Stumpf et al. | 83/468.2 |
| 6,431,042 | B1 * | 8/2002 | Brault et al. | 83/471.3 |
| 6,474,206 | B1 * | 11/2002 | Brunson | 83/471.3 |

FOREIGN PATENT DOCUMENTS

EP 0779122 A2 6/1997

OTHER PUBLICATIONS

U. Frisch, Partial European Search Report, Jul. 4, 2005, Munich. Annex to the European Search Report on European Patent Application No. EP 05 01 0595.
U. Frisch, Partial European Search Report, Application No. EP02250630, Jul. 4, 2003, Munich, European Patent Office.
U. Frisch, Annex to the European Search Report, Application No. EP02250630 Jul. 4, 2003.

* cited by examiner

*Primary Examiner*—Phong H Nguyen
(74) *Attorney, Agent, or Firm*—Adan Ayala

(57) ABSTRACT

An improved miter saw comprises a base assembly, a table rotatably attached to the base assembly, a saw assembly pivotably attached to the table, a wear ring non-fixedly attached between the base assembly and the table and wear ring. Other inventions are described herein.

4 Claims, 5 Drawing Sheets

MITER SAW

CROSS-REFERENCE TO RELATED APPLICATIONS

This application derives priority under 35 USC §119(e) from U.S. Application Ser. No. 60/265,567, filed Feb. 1, 2001.

BACKGROUND OF THE INVENTION

The invention relates to miter saws.

Miter saws are power tools typically comprising a base assembly, a table rotatably attached to the base assembly (for allowing the user to change the miter angle) and a saw assembly pivotably attached to the table so that the saw assembly can move downwardly for cutting. The saw assembly typically includes a blade and a motor driving the blade.

It is well known in the art to provide a wear ring between the base assembly and the table to minimize binding and friction therebetween.

Usually the wear ring consists of a metal ring disposed between the table and the base assembly. Typically this metal ring is bolted down onto the base assembly or the table so that the wear ring does not rotate.

SUMMARY OF THE INVENTION

It is an object of the invention to provide a miter saw with a better wear system. In accordance with the present invention, an improved miter saw is disclosed. An improved miter saw comprises a base assembly, a table rotatably attached to the base assembly, a saw assembly pivotably attached to the table, a wear ring non-fixedly attached between the base assembly and the table and wear ring. Other inventions are described herein.

Additional features and benefits of the present invention are described, and will be apparent from the accompanying drawings and detailed description below.

BRIEF DESCRIPTION OF THE DRAWINGS

The accompanying drawings illustrate preferred embodiments of the invention according to the practical application of the principles thereof, and in which:

FIG. 5 is partial cross-sectional view of the miter lock mechanism where

FIG. 9 illustrates a second embodiment of the bevel scale mechanism according to the invention, where

DETAILED DESCRIPTION

Figure 1:
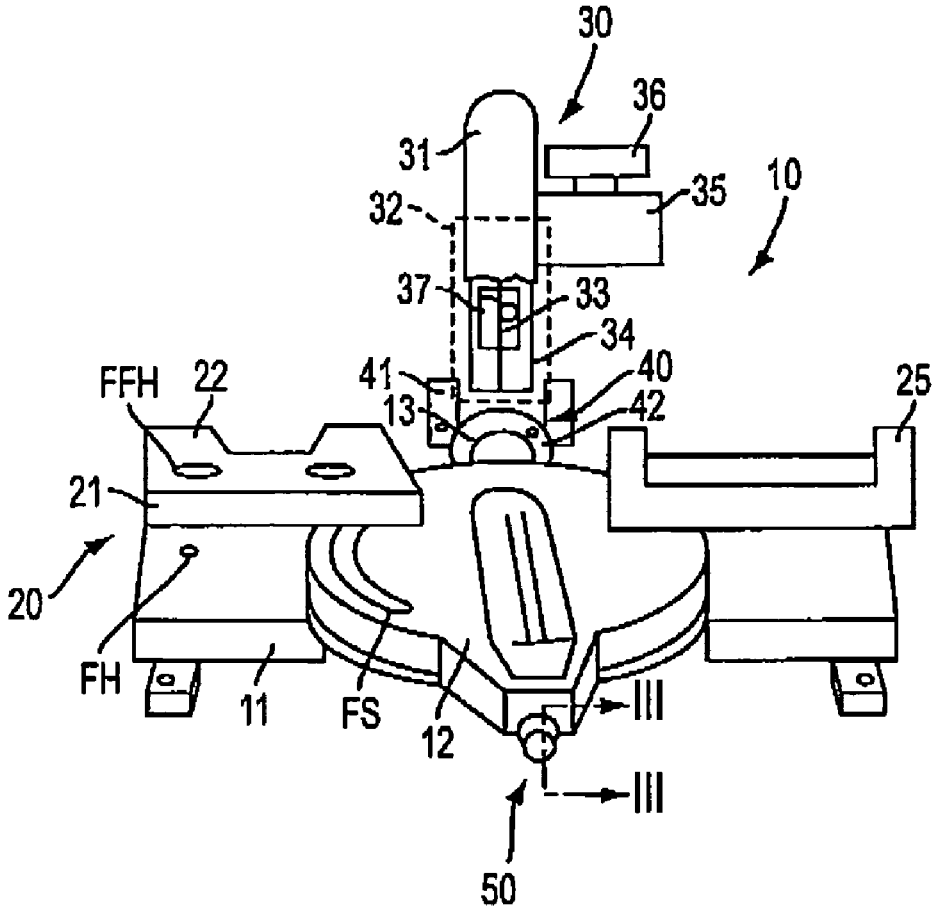
FIG. 1 is an elevated front perspective view of a miter saw according to the invention.

The invention is now described with reference to the accompanying figures, wherein like numerals designate like parts. FIG. 1 shows a power tool 10. Persons skilled in the art should recognize that the power tool 10 may be a chop saw, miter saw, compound miter saw, and/or sliding miter saw. For the purpose of clarity, a power tool 10 shall be referred to herein as miter saw 10.

Miter saw 10 comprises a base assembly 11, a table 12 rotatably attached to the base assembly, a saw assembly 30 pivotably attached to the table 12, and a fence assembly 20 fixedly attached to the base 11. Preferably, the fence assembly 20 comprises a fixed fence 21 fixedly attached to the base assembly 11 and a slidable fence 22 slidably attached to the fixed fence 21. Persons skilled in the art are hereby referred to U.S. Pat. No. 5,297,463, which is hereby wholly incorporated by reference. A second fence 25 may also be fixedly attached to base assembly 11. Preferably fixed fence 21, sliding fence 22 and/or a second fence 25 are co-planar.

The table 12 may have a cylinder 13, which is pivotably connected to the trunnion junction 40. Trunnion junction 40 preferably includes a trunnion 41 which is pivotably attached to the table 12 in a manner well-known in the art. Such pivotal connection would enable a user to change the bevel angle of the miter saw 10.

Saw assembly 30 is pivotably attached to table 12 via the trunnion junction 40 and cylinder 13. To enable a user to conduct the chopping operation, the saw assembly has an arm 34 which is pivotably attached to the trunnion 41.

Saw assembly 30 may also include an upper blade guard 31 disposed on the arm 34, motor housing 35 for housing a motor (not shown), a handle 36 disposed on the motor housing 35 and/or upper blade guard 31 for allowing the user to move the saw assembly 30 downwardly, a blade 33 driven by the motor for cutting. The arm 34 may also include a dust collector 37 as is well known in the prior art. Persons skilled in the art are hereby referred to U.S. Pat. No. 5,819,619, which is wholly incorporated by reference herein.

Saw assembly 30 may also include a lower blade guard for covering the lower portion of blade 33.

Figure 2:
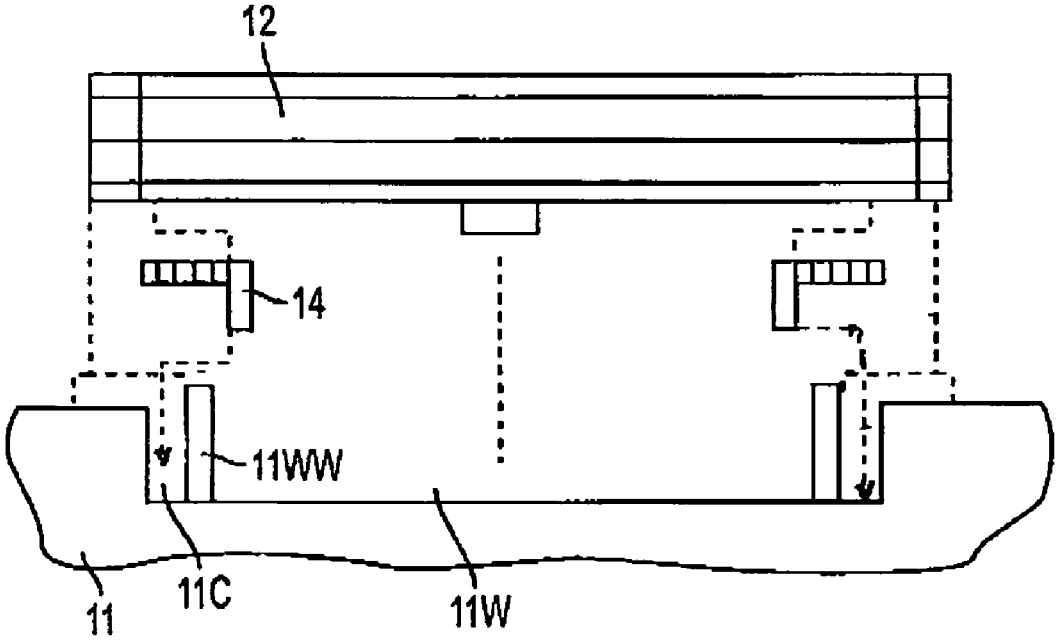
FIG. 2 is an exploded view of the base assembly.
Figure 3:
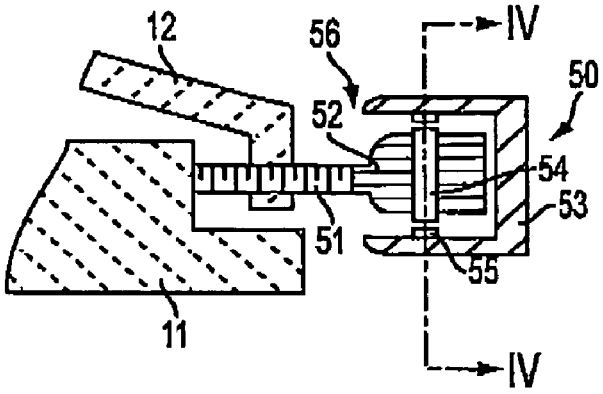
FIG. 3 is a cross-sectional view of the improved miter lock mechanism of FIG. 1, along line III-III as shown in FIG. 1.

As mentioned above, the table 12 is rotatably connected to base assembly 11. Referring to FIGS. 1 and 2, base assembly 11 may have a circular well 11W for receiving a wear ring 14. The wear ring 14 may be disposed within a channel 11C defined in well 11W by a wall 11WW. The wear ring 14 is not fixedly attached to base assembly 11. The wear ring is preferably sandwiched between base assembly 11 and table 12.

Persons skilled in the art will recognize that the composition of wear ring 14 should be an appropriate material, such as steel, rubber or any equivalent thereof, that will enable rotation of table 12 on wear ring 14. Preferably wear ring 14 is L-shaped so that it can be inserted into channel 11C and support table 12 at the same time.

Because the ring is not fixedly attached to base assembly 11 or to table 12, the wear ring 14 is allowed to rotate as necessary while utilizing both contact sides for longer life.

Referring to FIGS. 1 and 3-5, it is preferable to provide miter saw 10 with a miter lock mechanism 50. As mentioned above, table 12 is rotatably attached to base assembly 11. A user can change the miter angle of the blade by rotating table 12 relative to base assembly 11. In order to lock the rotational position of table 12, a miter lock mechanism is required. In the prior art, a simple screw/knob assembly allowed users to fix the rotational position of the table 12. However, such mechanism did not prevent users from over-torquing the knob, thus causing damage to the miter lock mechanism, the table 12 and/or the base assembly 11. An improved miter lock mechanism 50 is disclosed herein.

Miter lock mechanism 50 may include a screw 51 threadedly engaged through table 12 and contacting base assembly 11 in the locking position. A knob 53 is operatively connected to screw 51 for rotating screw 51. Miter lock mechanism 50 may also include a clutch mechanism 56 for preventing the user from over-torquing knob 53. The clutch mechanism 56 may include an auxiliary knob 52 fixedly attached to screw 51 for simultaneous rotation therewith. Auxiliary knob 52 may have teeth 54. Teeth 54 may engage extensions 55 disposed on knob 53.

Figure 4:
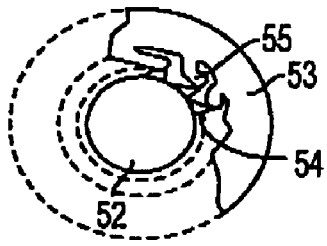
FIG. 4 is a partial cross-sectional view of the miter lock mechanism of FIG. 3, along line IV-IV as shown in FIG. 3.
Figure 5A:
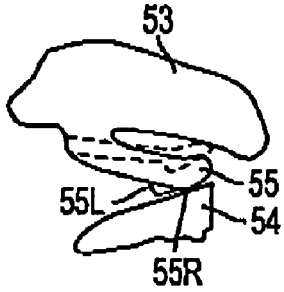
FIGS. 5A and 5B show different operational positions of the miter lock mechanism.
Figure 5B:
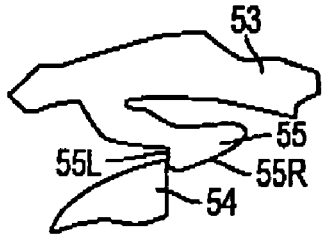

As shown in further detail on FIGS. 4 and 5, knob 53 preferably has extensions 55 which are resiliently connected to the knob 53 and are moveable between first position contacting teeth 54, and a second position bypassing teeth 54. Extension 55 may include a ramp 55R which moves along tooth 54 in the first position. Persons of ordinary skill in the art will recognize that the shape and form of tooth 54, extension 55, and/or ramp 55 will be designed in order to meet the desired torque requirements.

Persons skilled in the art will also recognize that, as the user rotates knob 53, the protrusion 55 will cause rotation of auxiliary knob 54 unless a predetermined torque limit is reached, upon which extension 55 will slide along tooth 54 until it moves to the second position where extension 55 bypasses tooth 54.

Extension 55 may have a latching area 55L, which is preferably located on the rear side of the ramp 55R. With such arrangement, when the user rotates the knob 53 for unlocking the miter lock, the latch area 55L will latch onto tooth 54, causing the knob 53 and auxiliary 52 to rotate together. Persons skilled in the art shall recognize that the actual shape of the latching area 55L and tooth 54 should be designed so as to minimize the movement of extension 55 between the first and second positions.

Persons or ordinary skill in the arts should also recognize that the extensions 55 and tooth 54 may be provided on the auxiliary knob 52, and knob 53, respectively, in order to achieve the same results.

Figure 14:
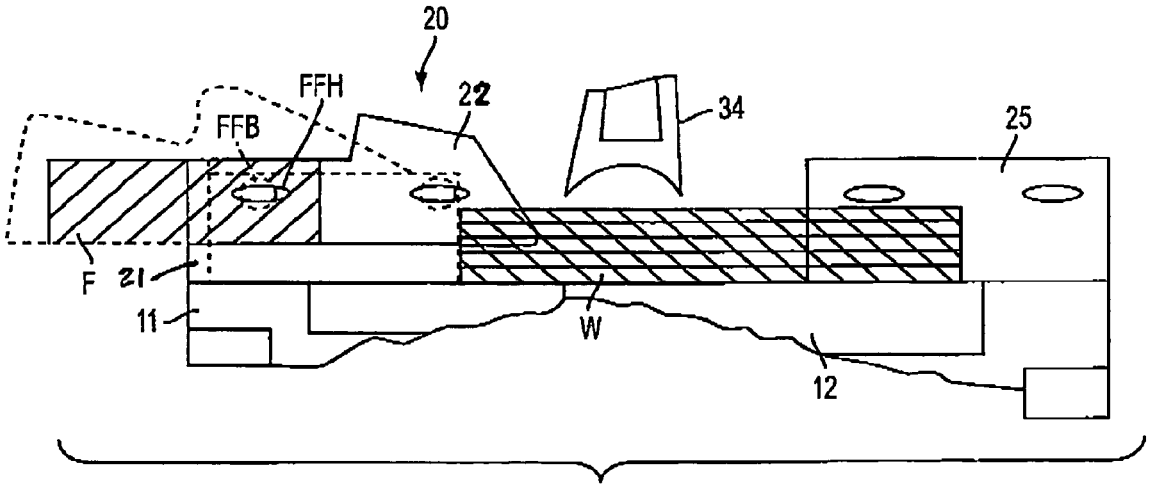
FIG. 14 illustrates a first fixture mount according to the invention.

Referring to FIG. 14, the miter saw 10 may be provided with means for mounting fixtures thereon. Fixture F may be attached on the miter saw 10 for supporting a workpiece W disposed on table 12 and/or base assembly 11. Fence assembly 20 may be provided with a hole FFH. Hole FFH may be either round or a slot, and should be of such size to allow the user to put a screw FFB therethrough. Preferably, the hole size will allow a number 8 screw therethrough. In other words, the hole FFH may have a diameter of about 3/16 of an inch.

Preferably, hole FFH is provided on the sliding fence 22, thus providing the user with moveable fixture F. Accordingly, the fence assembly 20 can be converted into a movable end stop, allowing the end user to move the workpiece W to a first desired position, then adjusting the sliding fence 22 to a second desired position, and moving the workpiece W to that second desired position.

Figure 15:
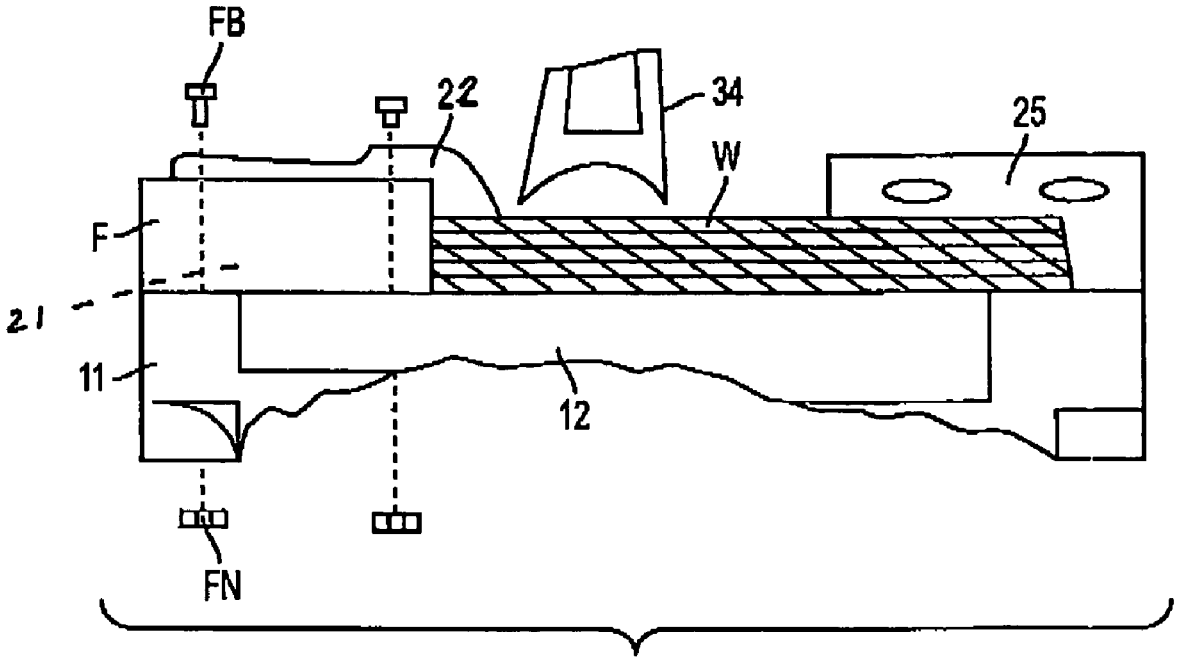
FIG. 15 illustrates a second fixture mount according to the invention.

FIGS. 1 and 15 illustrate a different fixture mount. In miter saw 10, the fixture F is preferably mounted to base assembly 11 and/or table 12 via bolts FB extending through the fixture F. Bolt FB may screw onto base assembly 11 and/or table 12 directly or into nuts F disposed underneath the base assembly 11 and/or rotatable table 12. Persons skilled in the art should recognize that bolt FB may extend through hole FH in base assembly 11 or through slot FS on table 12. Having a slot FS allow the user to move table 12 without removing bolt FB or fixture F.

Persons skilled in the art shall recognize that the fixture mounting holes FH, FFH and/or FS can be cast or machined into the different pieces.

Figure 6:
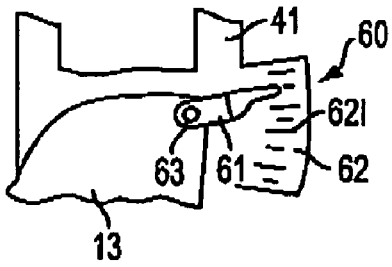
FIG. 6 is a partial front view of the bevel scale mechanism according to the invention.

Referring to FIG. 6, miter saw 10 may be provided with a bevel scale mechanism 60. Bevel scale mechanism 60 may be used to indicate the bevel angle of miter saw 10. Bevel scale mechanism 60 may include scale 62 on trunnion 41, and pointer 61 disposed on cylinder 13. Persons skilled in the art should recognize that scale 60 may be disposed on cylinder 13 and pointer 61 may be disposed on trunnion 41. Scale 62 may have indicia 62 I thereon to better denote the bevel angle.

Figure 7:
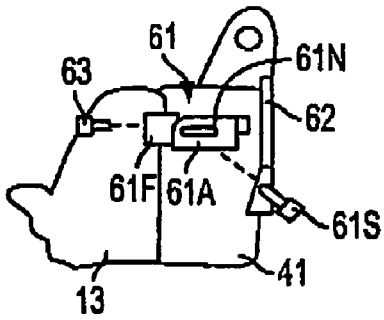
FIG. 7 is side view of the bevel scale mechanism of FIG. 6.
Figure 8:
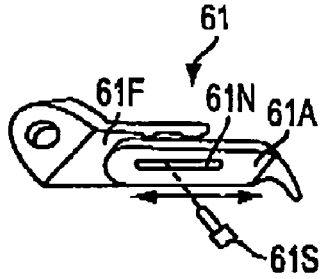
FIG. 8 is a close up view of the pointer of FIGS. 6 and 7.

It may be preferable to provide an adjustable pointer 61 to adjust the pointer close to the scale 62 without contacting the scale 62. Referring to FIGS. 6-8, adjustable bevel pointer 61 may include fixed portion 61F and an adjustable portion 61A removeably disposed on fixed portion 61F. Screw 61S may fix the location of adjustable portion 61A relative to fixed portion 61S. The bevel pointer 61 may then be attached to cylinder 13 via screw 63.

Screw 61 S may be threadedly extend through slots 61 N in adjustable portion 61A. Screw 61S may threadedly engage a nut (not shown) disposed behind fixed portion 61F or may be threadedly engaged into fixed portion 61F.

By connecting pointer 61 to cylinder 13 via screw 63, pointer 61 is thus adjustable via rotation about the longitudinal axis of screw 63 and/or moveable in a direction parallel to the longitudinal axis of screw 63.

Figure 9A:
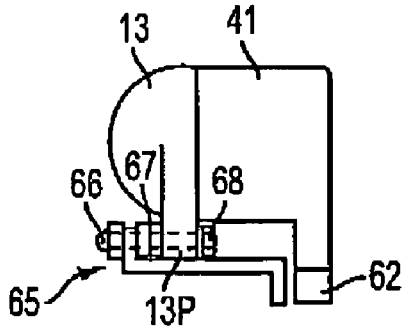
FIGS. 9A and 9B show different positions of the pointer.
Figure 9B:
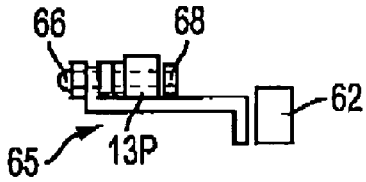

A second adjustable pointer 65 is shown in FIGS. 9A and 9B. The teachings of the previous embodiments are wholly incorporated by reference, where like numerals refer to like parts. In this embodiment, pointer 65 is again attached to cylinder 13 via a screw 66 which preferably extends through pointer 65 and protrusion 13P of cylinder 13. Screw 66 may be threadedly engaged to a nut 68 behind the protrusion 13P. The pointer 65 may be adjusted relative to the scale 62 by inserting washers 67 between pointer 65 and protrusion 13P. It may be preferable to provide a fixed number of washers so that the user may put some between screw 66 and pointer 65 and the remainder between pointer 65 and protrusion 13P.

Figure 10:
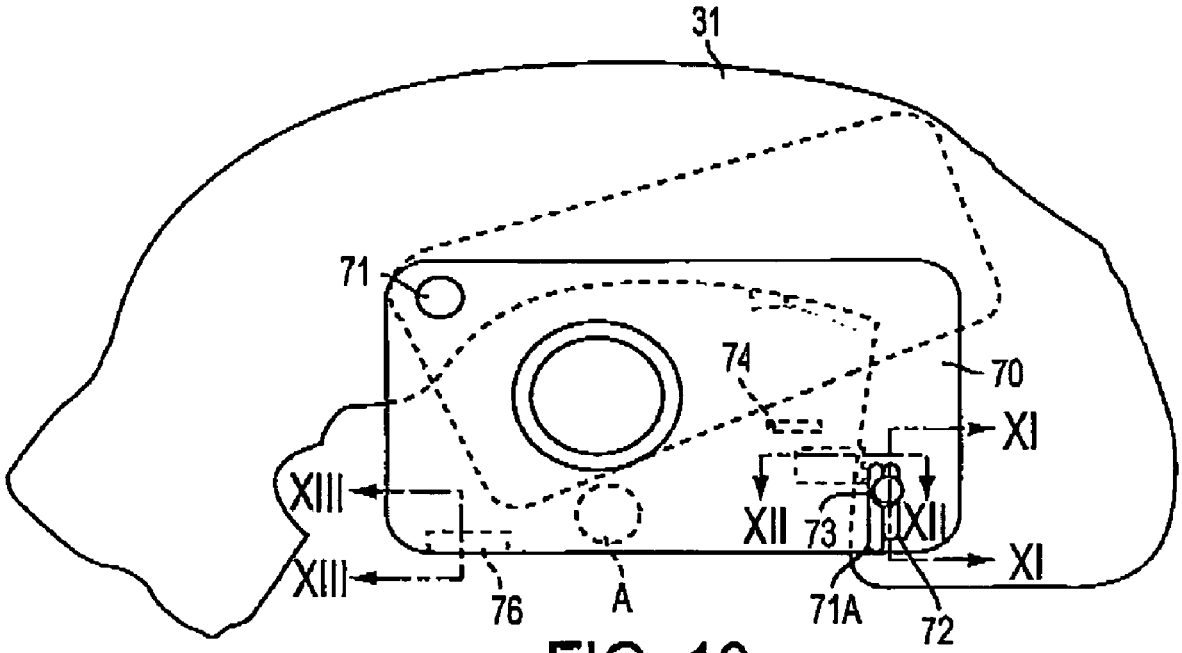
FIG. 10 is a partial side view of the upper blade guard and pivot blade according to the present invention.

Referring to FIGS. 10-11, upper blade guard 31 may have a pivot plate 70 pivotally attached to upper blade guard 31 via bolt 71 for rotatably supporting lower blade guard 32. Pivot plate 70 may be locked in a fixed position relative to upper blade guard 31 via bolt 73. Pivot plate 70 may also cover arbor A and must be pivoted in order to provide access to arbor A. To do so, the user needs to unscrew screw 73 so that it bypasses tab 71A. Once the screw 73 can bypass tab 71A, screw 73 will slide along slot 72. Persons skilled in the art will recognize that slot 72 may be closed slot as shown in FIG. 10 or an open slot so that the user can completely separate the pivot plate 70 and screw 73. Persons skilled in the art will also recognize that screw 73 is preferably threadedly engaged to upper blade guard 31.

Figure 11A:
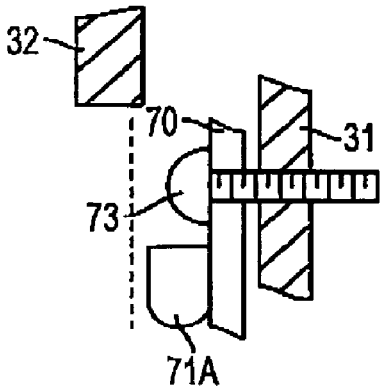
FIG. 11 is a partial cross-sectional view of along line XI-XI as shown in FIG. 10.
Figure 11B:
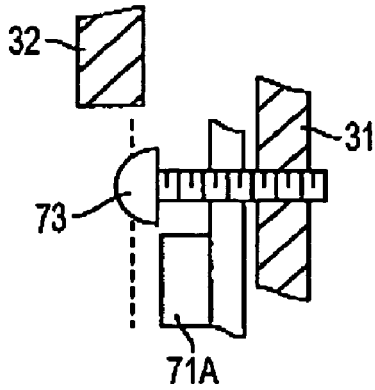

Referring to FIGS. 11A-11B, persons skilled in the art should recognize that when the head of the screw 73 is moved to bypass tab 71A, such position will block movement of lower blade guard 32. Accordingly, if a user wants to lower blade guard 32, the user will have to put pivot plate 70 in its original position and screw 73 thereon.

Pivot plate 70 may also have a tab 74 extending inwardly toward blade 33. Tab 74 extends inwardly so that it can contact upper blade guard 31 when the pivot plate 70 is pivoted. In other words, tab 74 limits the range of movement of pivot plate 70.

Figure 12:
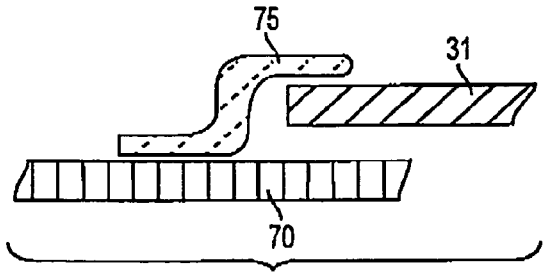
FIG. 12 is a partial cross-sectional view along line XII-XII as shown in FIG. 10.

Referring to FIGS. 10 and 12, pivot plate 70 may have channel tab 75, which preferably extends inwardly towards and parallel to blade 33. Upper blade guard 31 may extend between pivot plate 70 and channel tab 75. Such arrangement prevents pivot plate 70 from moving laterally excessively.

Figure 13:
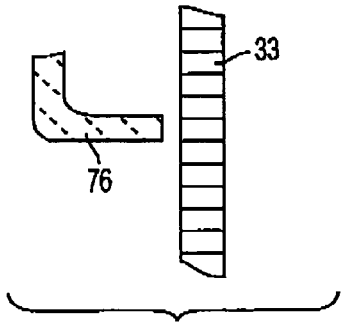
FIG. 13 is a partial cross-sectional view along line XIII-XIII as shown in FIG. 10.

Referring to FIGS. 10 and 13, pivot plate 70 may also have blade caliper tab 76. Blade caliper tab 76 extends inwardly towards blade 33. Preferably, tab 76 extends within several millimeters of blade 33. With such arrangement, tab 76 prevents blade 33 from moving laterally excessively during the rotation thereof, and from cutting upper blade guard 31.

Figure 16:
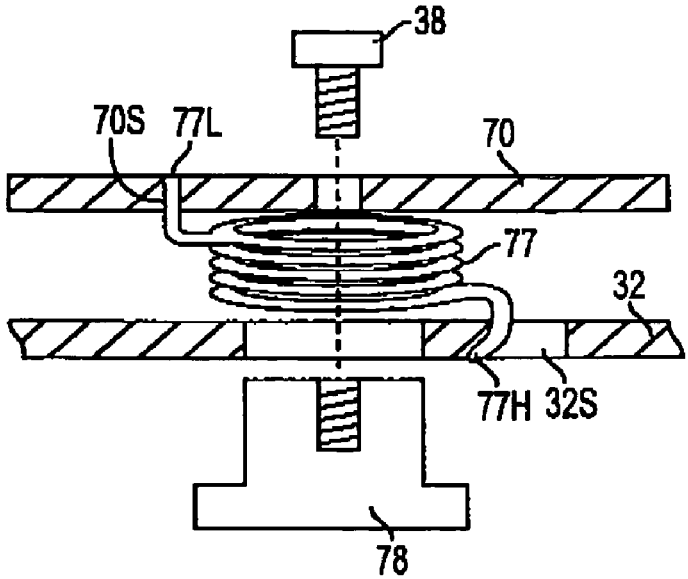
FIG. 16 is a partial cross-sectional view of the pivot plate/lower blade guard assembly.

FIG. 16 illustrates the connection between pivot plate 70 and lower blade guard 32. Preferably, a rotational spring 77 is captured between pivot plate 70 and lower blade guard 32. Preferably, one end of spring 77 is shaped like a hook 77H. Preferably, hook 77H is inserted through slot 32S and then released during assembly. Hook 77H will then move towards the end of slot 32S providing a durable junction that is easy to assemble.

Similarly, the other end of spring 77 may also be shaped as a hook and inserted through pivot plate 70. Alternatively, the other end of spring 77 is shaped like a bent leg 77L, which then may be inserted through slot 70S in pivot plate 70.

Preferably, pivot plate 70 is connected to lower blade guard 32 via a screw 38. Screw 38 may be inserted through lower blade guard 32 and threadingly engage pivot plate 70. Alternatively, screw 38 may be inserted through pivot plate 70 and lower blade guard 32 and threadingly engaged to a plate retainer 78. Preferably, a portion of plate retainer 78 extends through lower blade guard 32 and/or contact pivot plate 70.

Persons skilled in the art may recognize other alternatives to the means disclosed herein. However, all these additions and/or alterations are considered to be equal inside the present invention.

What is claimed is:

1. A chop saw comprising:

a base assembly; and a saw assembly pivotably attached to the base assembly, the saw assembly comprising an upper blade guard, a plate rotatably attached to the upper blade guard, a lower blade guard rotatably attached to the plate, and a screw engaging the upper blade guard for fixing the plate;

wherein at least one of the upper blade guard and plate have a first tab disposed near the screw and extending outwardly and substantially perpendicularly to the at least one of the upper blade guard and plate, the first tab extending from the at least one of the upper blade guard and plate a first distance, the screw being required to be moved a second distance longer than the first distance in order to pivot the plate so that the lower blade guard contacts the screw upon rotation of the lower blade guard, wherein the lower blade guard contacts the screw upon rotation of the lower blade guard after the screw has been moved the second distance.

2. The chop saw of claim 1, wherein the plate has a second tab extending inwardly which contacts the upper blade guard upon pivoting of the plate.

3. The chop saw of claim 1, wherein the plate has a second tab extending inwardly and defining a channel, the upper blade guard extending into the channel.

4. The chop saw of claim 1, wherein the plate has a second tab extending towards a blade.

* * * * *